US005697113A

United States Patent [19]

Shatz et al.

[11] Patent Number: 5,697,113

[45] Date of Patent: Dec. 16, 1997

[54] VENTILATED INFANT'S MATTRESS

[75] Inventors: Anat Shatz, 6 Simtat Yarmuch St., Kiryat Ono 55231; Yizhak Regev, Tel-Aviv; Amnon Schwartz, Moshav Nir Zvi; Yuval Sela, Ramat Efal, all of Israel

[73] Assignees: Aminach Bedding & Furniture Manufacturing Ltd., Ramla; Anat Shatz, Kirat Ono, both of Israel

[21] Appl. No.: 618,012

[22] Filed: Mar. 25, 1996

[30] Foreign Application Priority Data

Mar. 23, 1995 [IL] Israel ..... 113100

[51] Int. Cl.[6] ..... A47D 7/00; A47C 27/14

[52] U.S. Cl. ..... 5/655; 5/692; 5/694; 5/725

[58] Field of Search ..... 5/655, 484, 482, 5/725, 724, 726, 731, 732, 734, 692, 694

[56] References Cited

U.S. PATENT DOCUMENTS

| | | | |
|---|---|---|---|
| D. 259,458 | 6/1981 | Fuller et al. | 5/655 |
| 2,614,273 | 10/1952 | Yancofski | 5/484 |
| 2,697,480 | 12/1954 | du Bois et al. | 5/655 |
| 3,729,752 | 5/1973 | Huggins | 5/655 |
| 4,359,045 | 11/1982 | Cozzi | 5/655 |
| 4,566,449 | 1/1986 | Smith | 5/655 |
| 5,305,483 | 4/1994 | Watkins | 5/725 |
| 5,440,770 | 8/1995 | Nichols | 5/655 |
| 5,463,785 | 11/1995 | McKeel | 5/724 |

*Primary Examiner*—Alexander Grosz
*Attorney, Agent, or Firm*—Helfgott & Karas, P.C.

[57] ABSTRACT

An infant's mattress comprising a bottom base and a top surface, the latter having an elongated trough-like portion slanted between an upper end and a lower end thereof and being adapted to accommodate at least the torso of an infant lying on its back.

5 Claims, 4 Drawing Sheets

FIG. 1
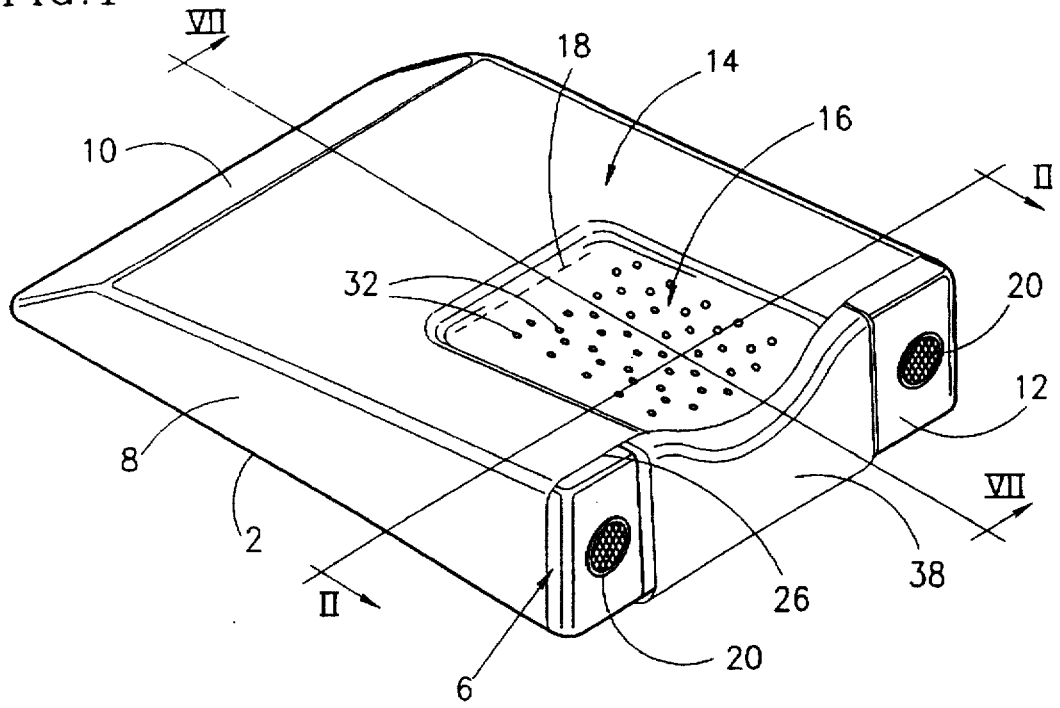
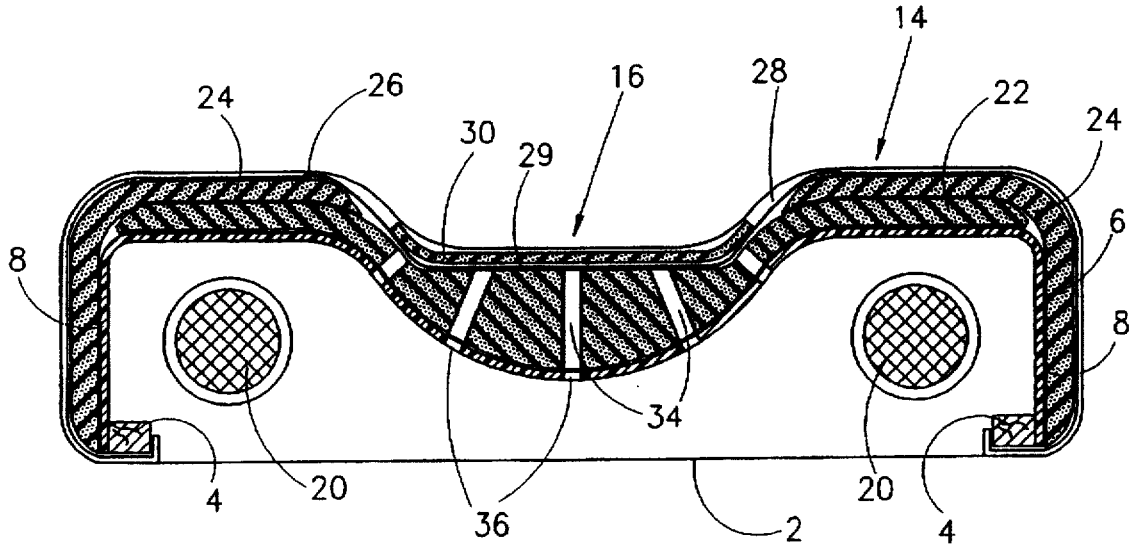
FIG. 2

VENTILATED INFANT'S MATTRESS

FIELD OF THE INVENTION

The present invention is in the field of mattresses and more specifically it is concerned with a mattress for infants useful in preventing sudden infant death syndrome (SIDS).

BACKGROUND OF THE INVENTION

SIDS is considered as the major cause of death among infants at their first year of life. The causes of SIDS are mostly unexplained although recent researchers show connection between SIDS and blockage of the upper respiratory system (URS).

It is today a recommendation of medical authorities in many countries, to lay an infant on his back with its spine aligned (straight head position—SHP), whereby the URS is maximally opened and whereby the danger of re-breathing of exhaled air is reduced.

In order to overcome the problem of an infant aspirating its stomach content (the syndrome known as gastro-eosophgial reflux), it is further recommended by physicians to lay an infant with its torso slightly elevated while maintaining the SHP.

SUMMARY OF THE INVENTION

It is an object of the present invention to provide a mattress for infants useful in preventing SIDS. The mattress according to the present invention encourages an infant to lay on its back and has means which hinder it from turning over. In accordance with a preferred embodiment, the mattress provides means for elevating the infant's torso while maintaining the SHP.

According to the present invention there is provided an infant's mattress comprising a bottom base and a top surface, the latter having an elongated trough-like portion slanted between an upper end and a lower end thereof and being adapted to accommodate at least the torso of an infant lying on its back.

In one embodiment of the present invention, at least part of said top surface is inclined with respect to said base.

The mattress is further provided with a buttock stop ascending from or within said trough-like portion, adapted to support the buttock of the infant so as to prevent it from sliding down.

According to a preferred embodiment of the present invention said trough-like portion comprises a plurality of ventilation apertures. Furthermore, the mattress may comprise means for forcing air through said apertures in order to improve air circulation. Alternatively, or in combination, suction means may be provided for draining stomach content secreted by the infant.

Furthermore, the mattress according to the present invention comprises at least one pocket beneath said trough-like portion,said pocket holding a removable absorbent member adapted to absorb liquid excretions drained into said apertures.

The invention further comprises means for changing the degree in which said trough-like portion is inclined with respect to the base.

BRIEF DESCRIPTION OF THE DRAWINGS

For better understanding, the invention will now be described in a non-limiting way, with reference to the accompanying drawings in which:

FIG. 1 is an isometric view of a mattress according to the present invention;

FIG. 2 is a cross-section along line II—II in FIG. 1;

DETAILED DESCRIPTION OF A PREFERRED EMBODIMENT

Figure 3:
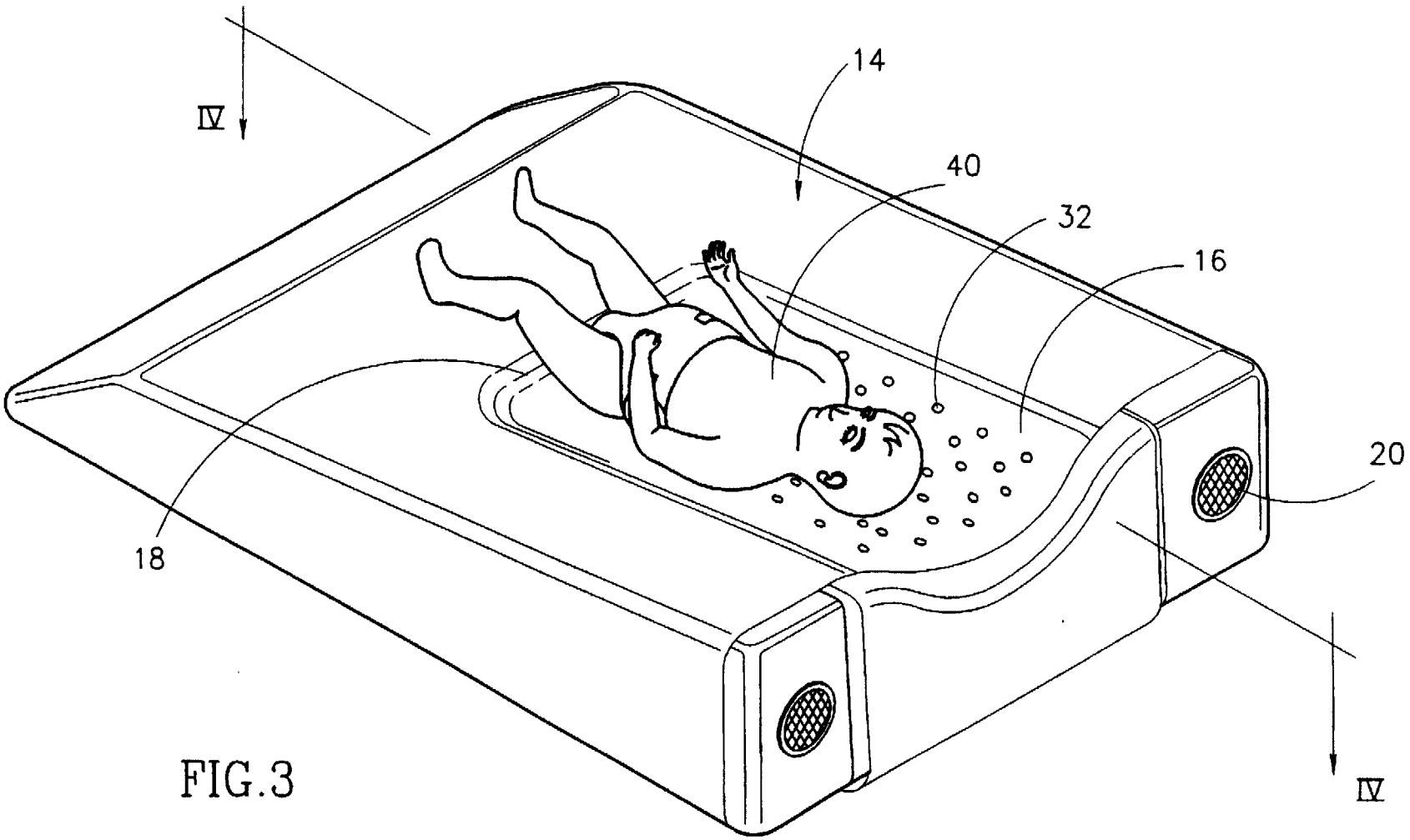
FIG. 3 is an isometric view of the mattress according to the present invention showing an infant lying thereon.

Attention is first directed to FIGS. 1 and 2 of the drawings illustrating a mattress having a rectangular base 2 reinforced by an internal frame 4 supporting a hollow rigid structure 6, made for example of a plastic material, having side walls 8, aft and fore end walls 10 and 12 respectively.

A top surface 14 of the structure 6 is inclined with respect to the base 2 and comprises an indented portion 16 extending from the fore end wall 12 to approximately the middle of the top surface 14 and it terminates with an ascending portion 18. The indented portion 16 has a trough-like cross-section having dimensions suitable for comfortably accommodating the torso of an infant aging about between 0 to 12 months.

The rigid structure 6 comprises at its fore end wall 12 two ventilation openings covered by grills 20 adapted for ventilating the space confined within the structure. The top surface 14 of the mattress is cushioned by a first layer 22 made of a sponge or foam material, which layer thickens at the zone of the indented portion 16. A second layer 24 cushions the side walls 8 and selected portions of the top surface 14.

The mattress is covered with an external cover 26, preferably made of a washable material such as PVC and it comprises an internal pocket 28 extending along the indented portion 16 having a bottom face 29 made of a webbed fabric, the pocket 28 holds a removable filtering layer 30 suitable for absorbing regurgitations and other liquids secreted by the infant.

The cover 26 comprises at the zone of the indented portion 16 a plurality of apertures 32 and the first cushioning layer 22 and the rigid structure at its indented portion 16 also comprise apertures 34 and 36 respectively, in register with said openings 32 of the external cover 26, whereby the apertures 32 are vented to the space confined within the structure of the mattress.

A flap cover 38 covers the fore end wall 12 of the mattress, concealing the inner components of the mattress.

Figure 4:
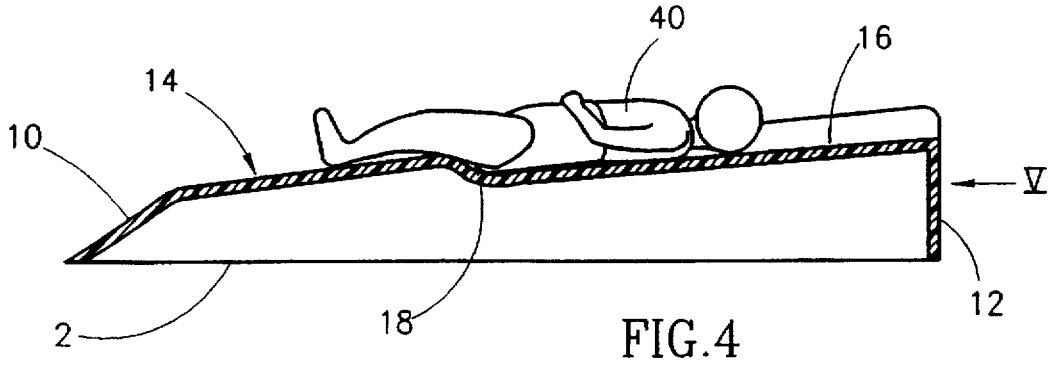
FIG. 4 is a cross-section along line IV—IV in FIG. 3.
Figure 5:
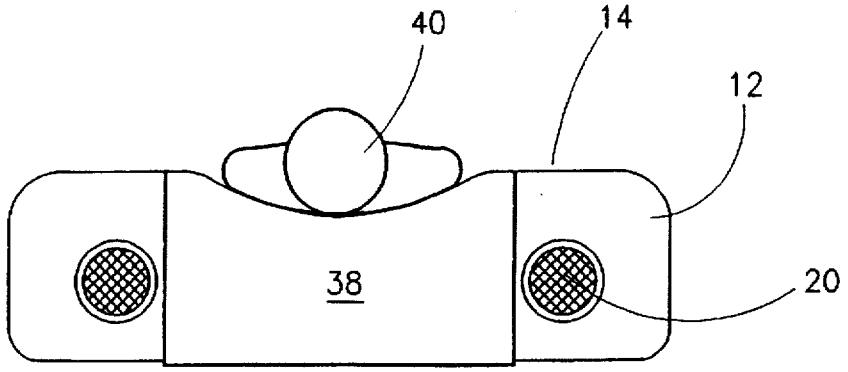
FIG. 5 is an elevation from the direction of arrow V in FIG. 4.

Reference is now made also to FIGS. 3 to 5 of the drawings showing an infant 40 laying on the mattress. As shown, the shape and size of the mattress are so designed so as to comfortably accommodate an infant aging about 0 to 12 months laying on its back, with its torso received within the indented portion 16 and its legs resting on the top surface 14, while its buttocks are supported by the ascending portion 18, preventing the infant from sliding down, whereas the indented portion 16 hinders it from turning over. Furthermore, the ascending portion 18 encourages the infant to lay on its back, as other positions are not comfortable.

The apertures 32 in the indented portion 16 serve both for ensuring air circulation thus preventing re-breathing of exhaled air and for draining vomit and other secretions, whereby air circulates via the apertures 32 and through the ventilation openings 20 and secretions drain through the apertures 32 and are absorbed by the removable filtering layer 30.

Figure 6A:
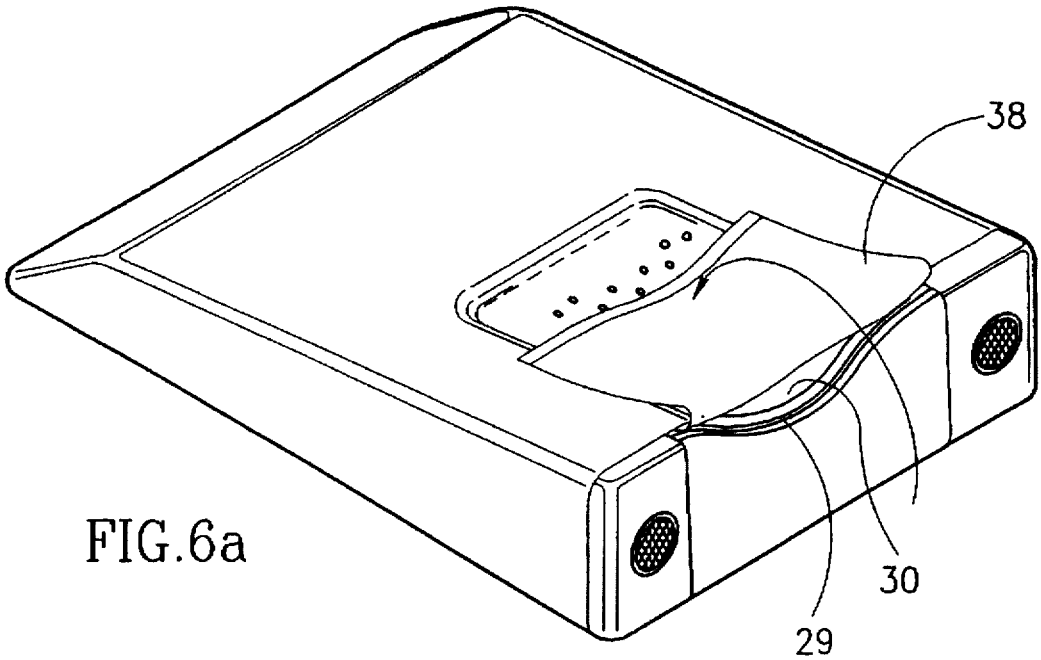
FIGS. 6*a* and 6*b* are isometric views of the mattress according to the present invention illustrating how an absorbent filter layer is removed from the mattress.
Figure 6B:
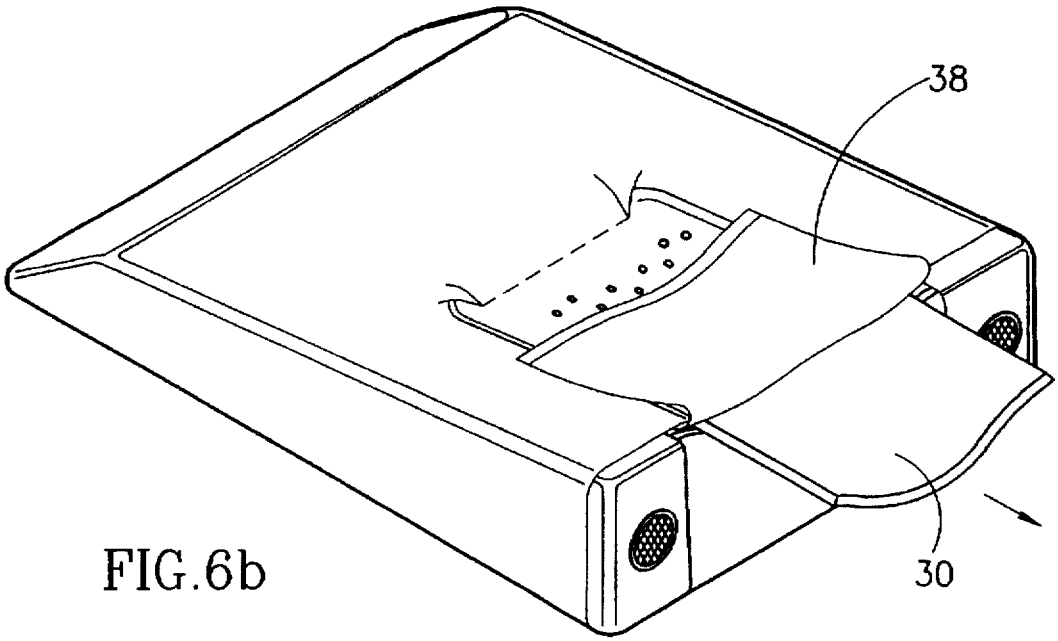

As shown in FIGS. 6*a* and 6*b*, the flap cover 38 may be opened to enable access to the filter layer 30 for replacing by a fresh one.

Figure 7:
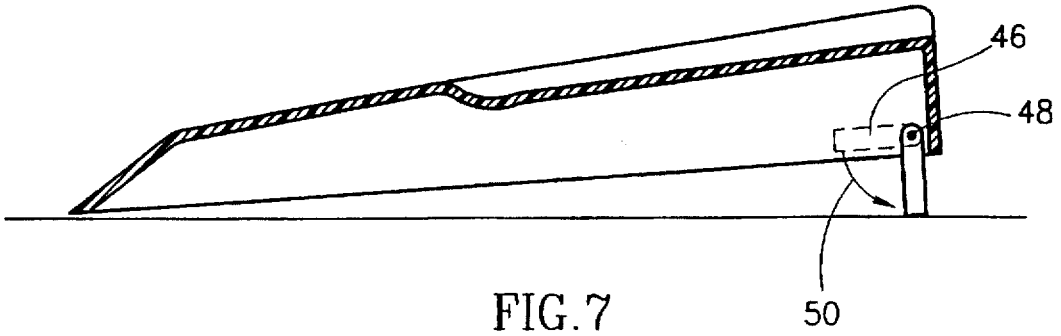
FIG. 7 is a cross-section along line VII—VII in FIG. 1 showing how the angle of inclination of the top surface is changed.

Attention is now directed to FIG. 7 showing one of two elevating legs 46 pivoted at 48 adjacent the fore end of the mattress (illustrated in its folded position by the dashed line). If it is required to increase the degree of inclination of the mattress, e.g. according to a physician's instructions in case of an infant suffering from frequent regurgitations, then the leg 46 is rotated to its open position (illustrated by the full line) and the angle of inclination of the mattress is increased. It should be obvious to a skilled person that various other means may be designed for increasing or decreasing the angle of inclination as may be required.

In the embodiment hereinabove described, the ventilating openings 20 are positioned at the fore end wall of the mattress and the removable filter layer 30 is accessible also from the fore end wall 12. However, it should be obvious to a person versed in the art that other designs are possible as well. It should also be obvious to a skilled person that forced air ventilation means and/or suction means may be connected to the openings 32 so as to improve their efficiency.

We claim:

1. An infant's mattress comprising:

a bottom base and a top surface, the top surface having an elongated trough-like portion slanted between an upper end and a lower end thereof and being contoured to accommodate at least the torso of an infant lying on its back, at least said trough-like portion having a plurality of ventilating apertures;

at least on pocket beneath said trough-like portion, said pocket holding a removable absorbent member for absorbing liquid secretions drained into said apertures.

2. An infant's mattress according to claim 1, wherein at least part of said top surface is inclined with respect to said base.

3. An infant's mattress according to claim 1, wherein said apertures are vented by forced air or by suction means.

4. An infant's mattress according to claim 1, further comprising a mechanism for changing the degree to which said trough-like portion is inclined with respect to a support surface.

5. An infant's mattress according to claim 1, further comprising a sheet suitable for covering at least the top surface of the mattress, said sheet having a plurality of holes at least at a zone corresponding with said apertures.

* * * * *